US005551796A

United States Patent [19]

Anderson, Jr. et al.

[11] Patent Number: 5,551,796

[45] Date of Patent: Sep. 3, 1996

[54] MOVEABLE BARRIER

[75] Inventors: Hugh G. Anderson, Jr., Arnold; Roy T. Shawn, Grasonville; Elmer F. Currence, Jr., Baltimore, all of Md.

[73] Assignee: Emergency Public Safety Services, L.L.C., Grasonville, Md.

[21] Appl. No.: 375,825

[22] Filed: Jan. 20, 1995

[51] Int. Cl.[6] ..... E01F 13/00

[52] U.S. Cl. ..... 404/6; 256/13.1; 49/385

[58] Field of Search ..... 404/6, 7, 9; 256/13.1; 49/35, 49, 131, 340, 385

[56] References Cited

U.S. PATENT DOCUMENTS

| | | | |
|---|---|---|---|
| 564,676 | 7/1896 | Witherell et al. | 49/385 |
| 2,807,107 | 9/1957 | Goulet | 49/385 |
| 4,330,958 | 5/1982 | Richmond | 49/340 X |
| 4,630,395 | 12/1986 | Nasatka | 49/49 |
| 4,658,543 | 4/1987 | Carr | 49/340 X |
| 4,782,628 | 11/1988 | Gaddis | 49/340 |
| 5,009,542 | 4/1991 | Hardin, Jr. et al. | 404/6 |
| 5,149,224 | 9/1992 | Smith | 404/6 |
| 5,181,794 | 1/1993 | Wilson et al. | 404/6 |
| 5,211,503 | 5/1993 | Quittner | 404/6 |
| 5,217,318 | 6/1993 | Peppel | 404/6 |
| 5,230,582 | 7/1993 | Schmitt et al. | 404/6 |
| 5,263,281 | 11/1993 | Osborn | 49/340 X |
| 5,351,440 | 10/1994 | Vincent | 49/340 |

*Primary Examiner*—David J. Bagnell
*Assistant Examiner*—James A. Lisehora
*Attorney, Agent, or Firm*—Foley & Lardner

[57] ABSTRACT

A moveable highway barrier includes a hinged shell and a stationary barrier section. The stationary barrier section contains a mechanism for raising the hinged shell between a standard position (also known as the lowered or closed position) and an open position (also known as the raised position). When the hinged shell is in the open position, vehicles, such as emergency vehicles, can traverse through the opening. The hinged shell can overlap a neighboring fixed barrier to provide lateral support. Additional support can be achieved through the use of a gravity or spring-loaded pin engaging with a hole in the ground. The system is signalled by a remote control.

25 Claims, 7 Drawing Sheets

MOVEABLE BARRIER

BACKGROUND OF THE INVENTION

The present invention relates to highway barriers and more particularly, to barriers, sometimes called "jersey walls," which are normally positioned in the middle of a road to serve as lane dividers between opposing streams of traffic. These barriers can also be used for perimeter security around real property, such as an embassy or other location requiring high security measures.

These barriers are generally made of concrete and are designed to withstand lateral force from, for example, a vehicle which is out of control and crashes into the barrier. A problem presented by these barriers is their restriction of vehicle traffic to one direction, such that an emergency vehicle travelling in one direction cannot cross to the other side of the highway to travel in the opposite direction to respond to an emergency situation. Various measures have been taken to minimize this problem. One such measure is to incorporate gaps into a wall of barriers such that the gaps provide an opportunity for an emergency vehicle to make a U-turn for travel in the opposite direction. These gaps, however, present a hazard in that they invite other drivers to make illegal U-turns and inevitably result in accidents.

Thus, there is a need for a movable barrier which prevents drivers from illegally making U-turns but allows police and other emergency vehicles to make U-turns when necessary.

Others have attempted to solve this problem, with varying degrees of success. One drawback of all the prior attempts to solve this problem is that the temporary portion of the barrier does not possess the lateral impact resistance of the adjacent, concrete, substantially fixed barriers. Thus, in a chain of barriers, the "temporary" barrier solutions present weak links in the jersey wall which lack sufficient crash resistance to meet state and federal requirements.

Other problems presented by the solutions to date stem from difficulties arising from inoperability of various sliding or folding mechanisms. For example, systems requiring tracks or pits to be incorporated into the road surface can become jammed or damaged as a result of ice or debris lodging therein. Thus, these designs do not present a solution with long-term viability without an undesired degree of periodic maintenance and housekeeping.

Another problem presented by some attempted solutions is that the "temporary" barrier does not have a profile matching its neighboring concrete barriers. Thus, at the interface between a fixed and "temporary" barrier, edge surfaces can exist which may lead to road hazards.

SUMMARY OF THE INVENTION

Accordingly, it is an object of the invention to provide a moveable barrier which can withstand the required lateral force and present a profile matching that of the neighboring concrete barriers.

It is a further object of the invention to provide such a moveable barrier in a configuration which is not susceptible to damage and/or inoperability caused by ice or roadside debris which can interfere with track operation or with operation of other mechanically moving parts.

It is also an object of the invention to provide a moveable barrier which is a long-term solution to the present problem and does not require undesired preventive maintenance or housekeeping.

An apparatus according to the invention overcomes the above problems by providing a moveable highway barrier which includes two sections. The first section is a stationary barrier section which is connected to a neighboring concrete barrier. The second section is a hinged shell which is pivotally linked to the stationary barrier section. Each of the stationary barrier section and hinged shell typically have a profile substantially similar to the neighboring concrete barrier sections. An apparatus according to the invention may also include drive means connected to the hinged shell for pivoting the hinged shell between an upright open position and a lowered closed position. Thus, when the shell is in the lowered closed position, a uniform barrier wall is presented.

A single hinged configuration of an apparatus according to the invention provides one hinged shell which pivots relative to an associated stationary barrier section. Alternatively, a double hinged configuration of an apparatus according to the invention provides two hinged shells, each pivoting with respect to its associated stationary barrier section.

For the single hinged configuration, when the hinged shell is in the closed position, it is preferable for a portion of the hinged shell to overlap the stationary barrier section and a substantially fixed concrete barrier opposite the stationary barrier section such that the combined hinged shell and stationary barrier section overlap at their joint and at each of the two neighboring concrete barriers, thus providing the required lateral strength.

Similarly, in the double hinged configuration, it is preferable for the free ends of the hinged shells (the ends opposite the associated stationary barrier sections) to overlap when the hinged shells are in the closed position. It is further preferred that the closed free ends be cam-locked or coupled and gravity pinned to the ground to provide further lateral support.

The drive means raises the hinged shell to an open position allowing vehicles to pass through the space normally filled by the hinged shell when it is in its closed position. Preferably, the drive means is substantially contained within the stationary barrier section and incorporates an electrohydraulic system whose piston rod end is connected to the hinged shell via a clevis pin. The electrohydraulic system further includes a solenoid valve, a hydraulic pump and a hydraulic fluid tank which are interconnected so as to provide the force necessary to move the shell between the open and closed positions.

Preferably, an accumulator is also interconnected to the electrohydraulic system. The accumulator is preferably located within the hinged shell.

The hydraulic fluid tank, or reservoir, is preferably placed in the bottom of the stationary barrier section, but may alternatively be placed proximate to the stationary barrier section, for example, in the ground beneath the stationary barrier section. The hydraulic fluid tank serves as a source or sink for hydraulic fluid being pumped, by the pump, from the tank to the accumulator or draining from the cylinder to the tank.

The pump is preferably driven by an electric motor, which is preferably provided electricity from a battery, which is preferably connected to a solar energy collector for recharging. The solar energy collector is preferably positioned along a top surface of the hinged shell. Other motors and power delivery systems can be used.

A receiver is preferably connected to the drive means to receive signals from a remote control. The receiver can contain a coding scheme to enable it to discriminate between remote controls such that only remote controls encoded in accordance with the coding scheme can transmit signals to the receiver which result in the appropriate drive signals being sent to the drive means.

In addition, a visible warning indicator, such as a strobe light, is provided to be activated when the shell is in motion and when it is in the upright position. Preferably, an audible alarm is also provided to be activated as the shell moves into the open or closed positions. Preferably, lights and/or alarms can be activated slightly before the shell is in motion.

To augment the lateral strength of the shell portion, the shell is preferably reinforced longitudinally and transversely and filled with structural foam to the extent possible. Moreover, a gravity pin, which assumes a substantially vertical orientation, may be provided to engage with a like size hole in the ground when the shell is in the closed position.

Also provided is a method of configuring a moveable highway barrier wherein a stationary barrier section is connected to a substantially fixed barrier, a hinged shell is connected to the Stationary barrier and drive means are connected to the hinged shell to pivot the hinged shell between upright open and lowered closed positions.

BRIEF DESCRIPTION OF THE DRAWINGS

These and other objects of the invention are accomplished according to the invention described herein with reference to the drawings wherein.

DETAILED DESCRIPTION OF THE DRAWINGS

Figure 1:
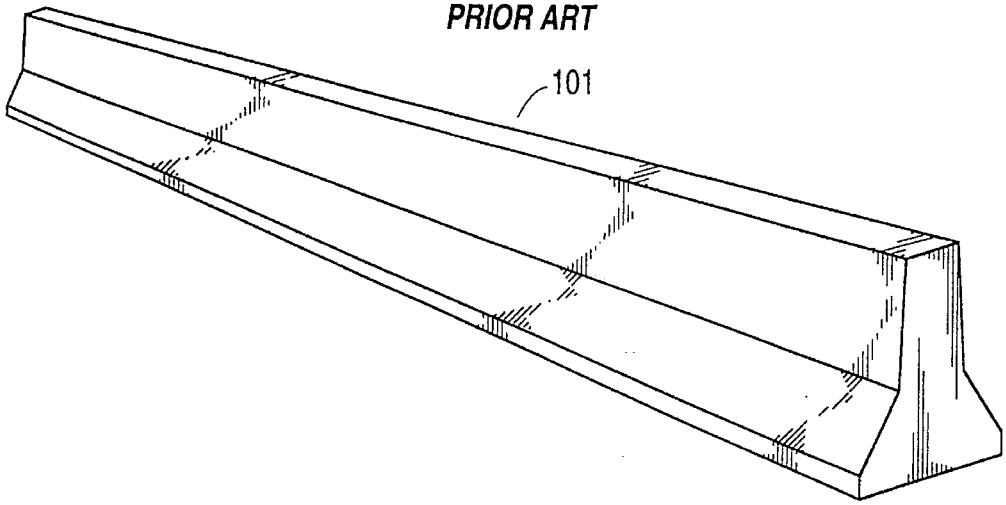
FIG. 1 PRIOR ART
FIG. 1 shows a conventional highway barrier.

FIG. 1 shows a typical highway barrier, or jersey wall, 101. Barrier 101 can be substantially continuous, or can be made up of a plurality of sections, either permanent or temporary. If made in sections, a typical section is made from reinforced concrete, weighs approximately 5,000 lbs., and measures 12 ft. in length, 32 inches in height, and 24 inches in width. The profile of barrier 101 is designed to return a vehicle's wheels to the highway if the vehicle accidently rides into the barrier.

Figure 2:
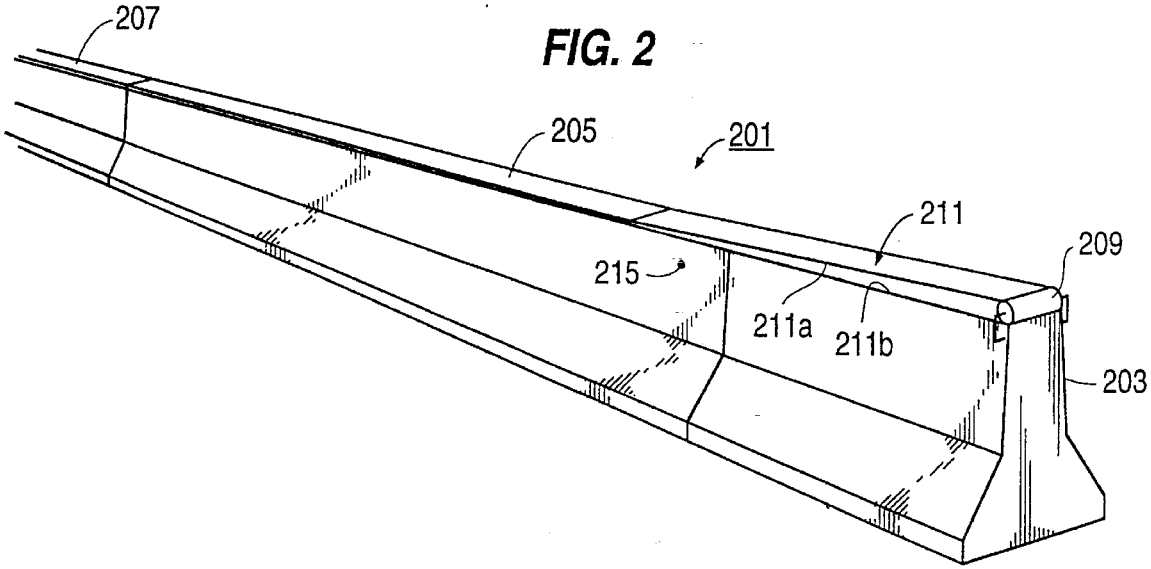
FIGS. 2, 2A, 2B and 2C show a moveable highway barrier in accordance with a first embodiment of the invention.

FIG. 2 shows a moveable highway barrier in accordance with a first embodiment of the present invention. Here, moveable barrier 201 includes stationary barrier section 203 and hinged shell 205. In the single hinged configuration, hinged shell 205 is dimensioned to be 12 ft. in length, such that when it is moved into the open or upright position, a 12 ft. wide space is provided for vehicle movement. Moveable barrier 201 provides a profile similar to that of barrier 101 shown in FIG. 1.

Figure 2A:
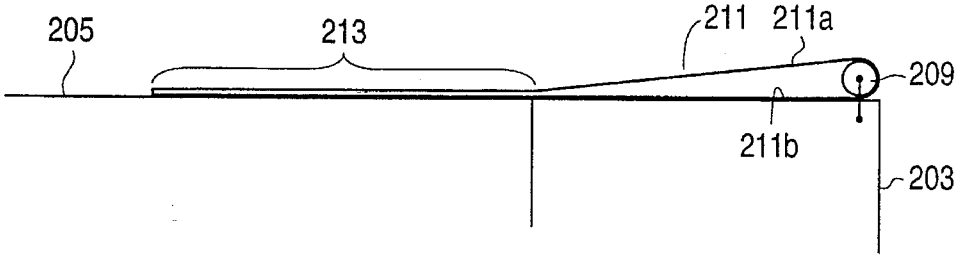

FIG. 2 also shows hinge 209 connected to stationary barrier section 203. Pivot arm 211 is connected to hinge 209, and is also connected to hinged shell 205. FIG. 2A shows a magnified view of these connections. As shown, pivot arm 211 is preferably made of a steel band positioned around hinge 209, with two sections 211*a* and 211*b* of the steel band joining near the intersection of stationary barrier section 203 and hinged shell 205. The two sections 211*a* and 211*b* thus provide a double thickness for being attached to hinged shell 205 by, for example, welding. The double thickness portion of pivot arm 211, which is welded to hinged shell 205, is shown in region 213 of FIG. 2A.

Returning to FIG. 2, also shown therein is clevis point 215. As shown in greater detain in FIG. 2B, this is the point at which piston rod 219 is connected to the hinged shell. Piston rod 219 and piston cylinder 223 comprise piston 221. A similar clevis point 217 is contained within stationary barrier section 203 for connecting piston cylider 221 to the stationary barrier section 203. Examples of dimensions l, m, n, o, p and q which have proven effective are, respectively, about 47.266 inches, about 11.146 inches, about 31 inches, about 44 inches, about 8 inches, about 3 inches.

Figure 2B:
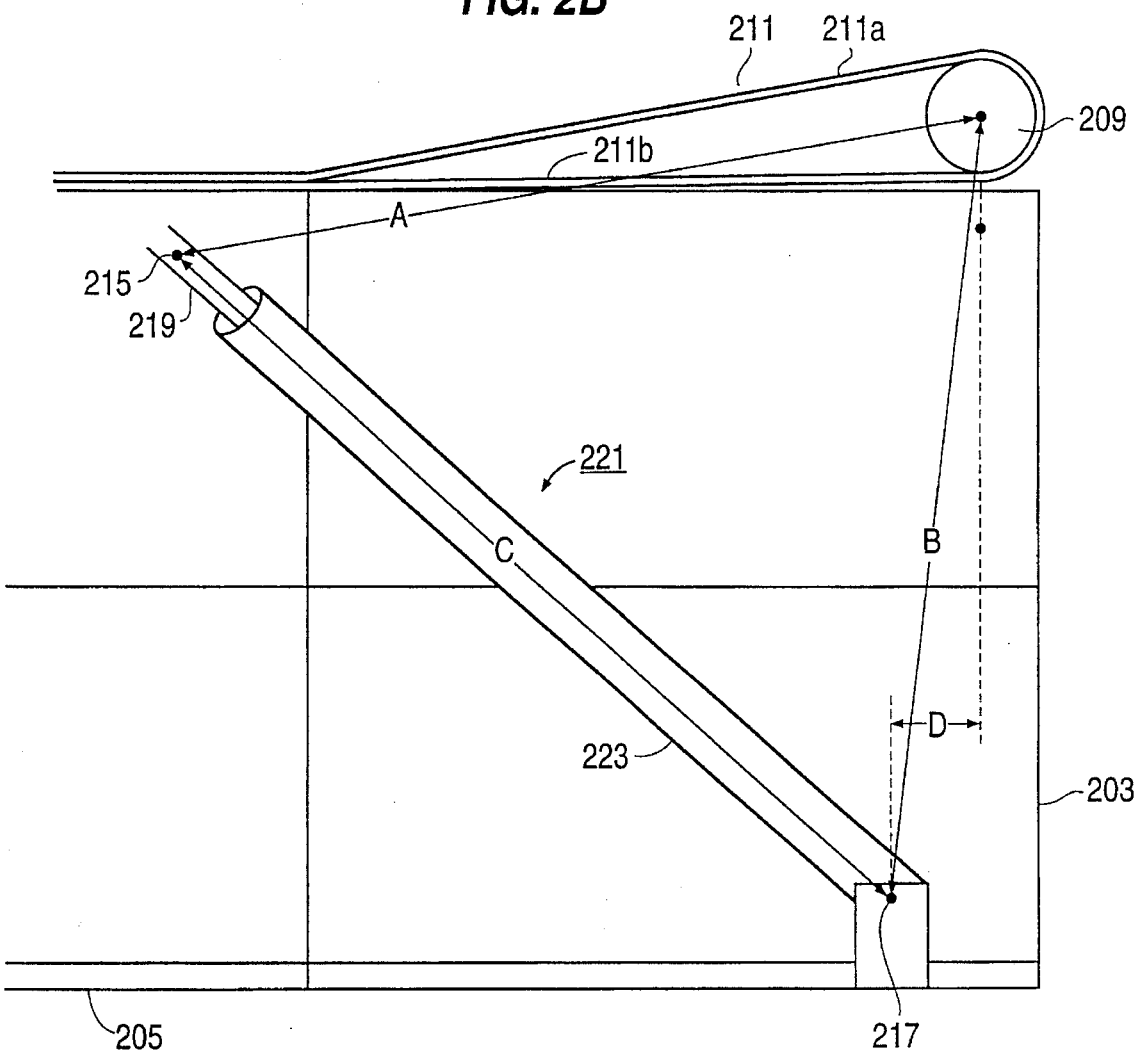
Figure 2C:
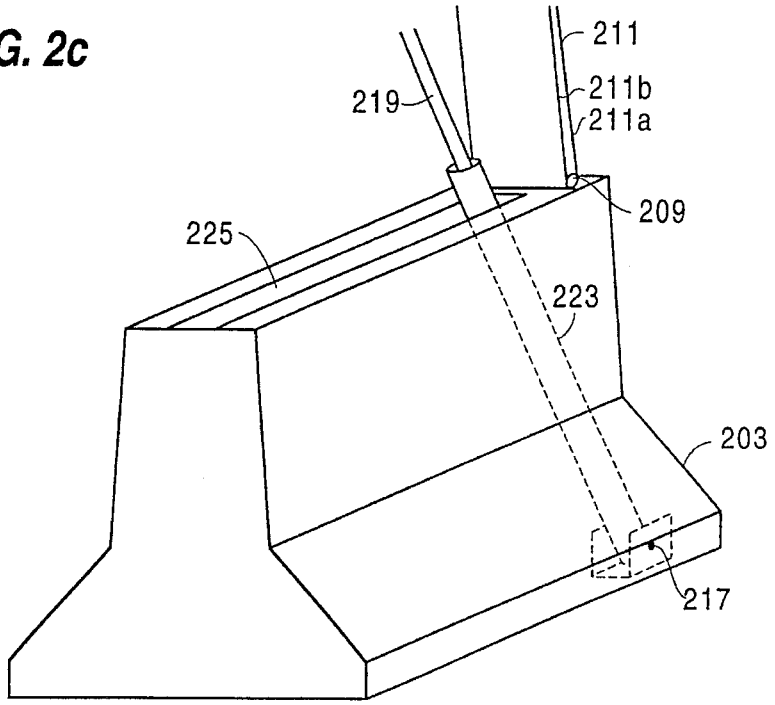

As shown in FIG. 2C, when piston rod 219 extends from piston cylinder 223 to cause hinged shell 205 to raise, piston 221 rotates around clevis point 217 in a direction towards hinge 209. The top of stationary barrier section 203 thus contains gap 225 within which piston 221 rotates during elevation of hinged shell 205.

As can be seen in FIG. 2, moveable barrier 201 can be placed in line with other barriers, such as barrier 207, which are identical to barrier 101 shown in FIG. 1. Thus, a uniform profile can be provided incorporating moveable barrier 201 into a series of barriers.

In a preferred embodiment, stationary barrier section 203 and hinged shell 205 are constructed of reinforced steel filled with structural foam to the extent possible. Ideally, stationary barrier section 203 houses therein an electrohydraulic system which is connected to hinged shell 205 to lift hinged shell 205 into an open position on command.

Figure 3:
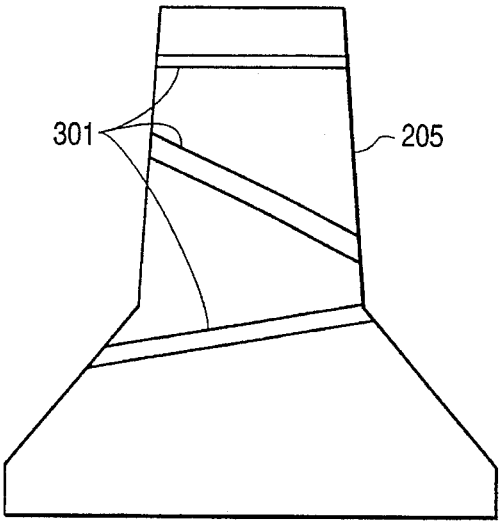
FIG. 3 shows an end view of an alternative of the first embodiment of the invention.

As shown in FIG. 3, which is a cross section of hinged shell 205, a plurality of steel structural supports 301 can be incorporated into hinged shell 205 to provide additional lateral strength thereto. Structural foam can also be placed within gaps between the structural supports 301.

Figure 4:
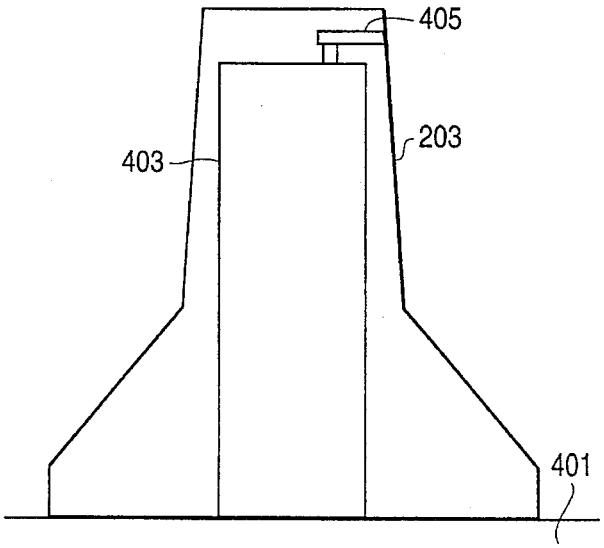
FIG. 4 shows an end view of an embodiment of a stationary barrier section in accordance with the invention.

FIG. 4 shows an end view of stationary barrier section 203 placed on road bed 401. As can be seen in the figure, stationary barrier section 203 contains, as drive means, the electrohydraulic system 403, which is similar to hydraulic units used on the dump beds of small dump trucks. Electrohydraulic system 403 is connected to a receiver 405 which receives commands in the form of signals from a remote control. Any receiving system can be used, e.g. RF, IR, optical etc. The receiver 405, which is typically an electronic device, converts the received signals into drive signals which it provides to electrohydraulic system 403. The receiver 405 may also contain decoding circuitry to discriminate between signals in order to insure that the source of the signals is authorized to issue commands.

As shown in FIG. 4, electrohydraulic system 403 is contained substantially within stationary barrier section 203. In an alternative variation, a portion of electrohydraulic system 403 may be contained in the ground directly beneath stationary barrier section 203.

Figure 5:
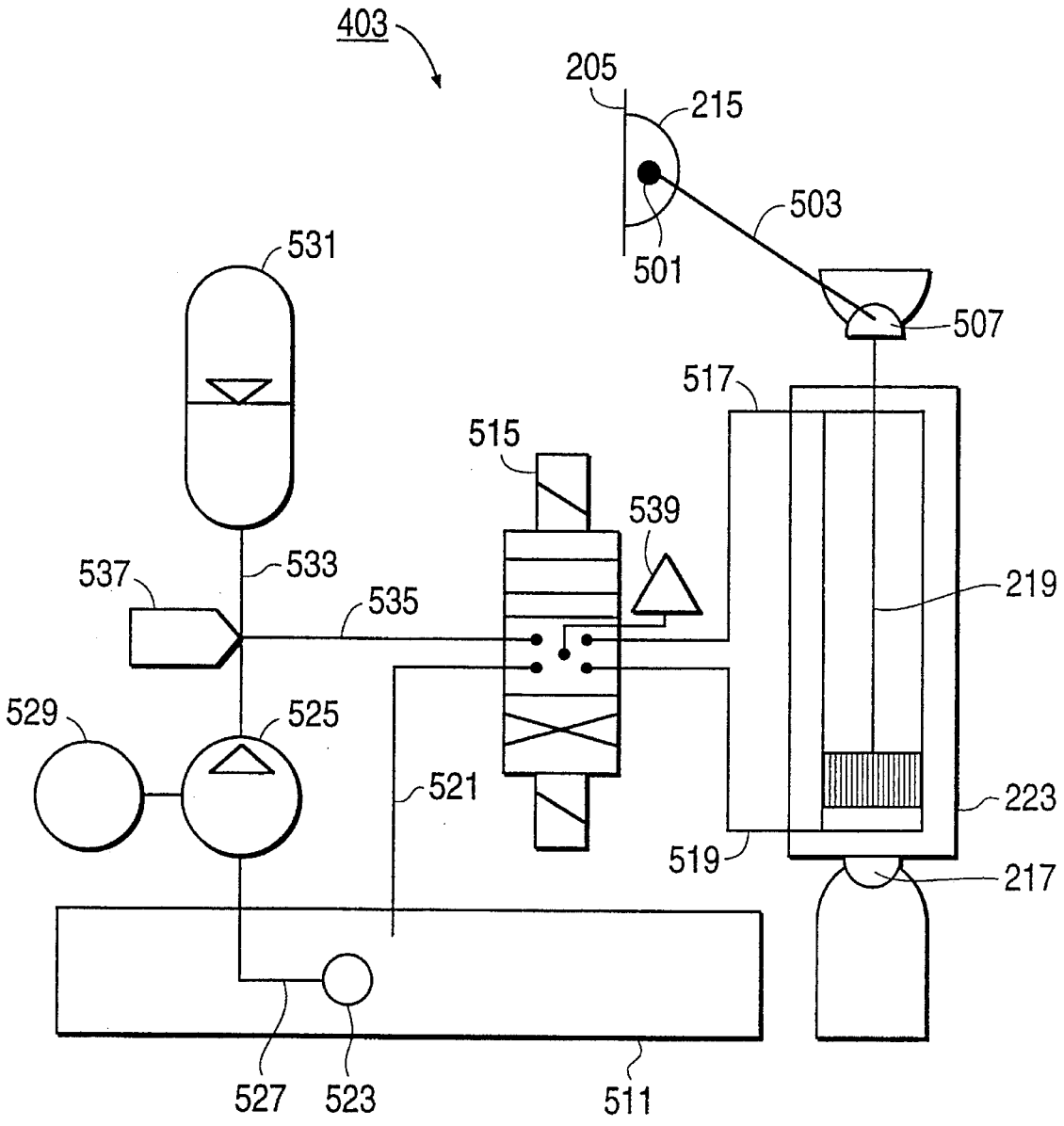
FIG. 5 provides a hydraulic schematic of the electrohydraulic system of one embodiment of the present invention.

FIG. 5 shows a hydraulic schematic of the principal parts of one example of electrohydraulic system 403. Here, hinged shell 205 is connected at hinge pin 501 to pivot arm 503 which is in turn connected to piston rod 219 at clevis/pivot point 507. Schematic elements 501, 503 and 507 are embodied in clevis point 215 as shown in FIG. 2B. A portion of piston rod 219 is contained within hydraulic cylinder (piston cylinder) 223 which is mounted to the base at clevis/pivot point 217. Hydraulic cylinder 223 is connected to solenoid valve 515 at its rod side by line 517 and at its piston side by line 519. Solenoid valve 515 is connected to hydraulic fluid tank 511 by line 521. Strainer 523 inside hydraulic fluid tank 511 is connected to hydraulic pump 525 by line 527. Hydraulic pump 525 is connected, for receiving power, to electric motor 529. Accumulator 531 is connected to solenoid valve 515 via lines 533 and 535. Line 533 also connects hydraulic accumulator 531 to hydraulic pump 525 with pressure transducer 537 coupled therebetween.

Referring to FIGS. 4 and 5, the operation of this embodiment of the invention will be described. Presume hinged shell 205 is in the lowered closed position, which could be considered the standard position, and electronic receiver 405 receives a signal to open the moveable barrier from a remote control unit contained, for example, in a police car or ambulance. After determining that the source of the signal is an authorized user, electronic receiver 405 will issue a drive signal to the electrohydraulic system 403.

In response to this drive signal, solenoid valve 515 links the hydraulic power of hydraulic accumulator 531 to the piston side of hydraulic cylinder 223 through lines 533, 535 and 519. As a result, piston rod 219 extends linearly out from hydraulic cylinder 223 and causes, via pivot arm 503 and hinge pin 501, hinged shell 205 to move into the upright open position. As discussed earlier with respect to FIGS. 2B and 2C, this causes hydraulic cylinder 223 to rotate around point 217.

Preferably, as hinged shell 205 approaches the fully opened position, a limit switch 539 is activated to stop the upper motion of hinged shell 205 by de-energizing the lifting solenoid of the valve 515 and then spring returning solenoid valve 515 to a center "no flow" position. Any subsequent radio signal will activate the opposite solenoid of valve 515, so as to return hinged shell 205 to the lowered closed or standard position. Thus, when the authorized vehicle has passed through the open space left by the upright open hinged shell 205, the operator of the vehicle can transmit a subsequent signal to electronic receiver 405 resulting in a subsequent drive signal to electrohydraulic unit 403, causing the hinged shell 205 to return to the standard position.

As described earlier, while piston rod 219 is being forced upwards in order to raise the hinged shell 205, hydraulic fluid is flowing into the piston side of hydraulic cylinder 223 via line 519. At the same time, hydraulic fluid on the rod side of hydraulic cylinder 223 is directed to hydraulic fluid tank 511 via lines 517 and 521.

When the hinged shell 205 is lowered into the closed position, hydraulic fluid on the piston side of hydraulic cylinder 223 will similarly return to hydraulic fluid tank 511 via lines 519 and 521. In this case, hydraulic fluid will be supplied to the rod side of hydraulic cylinder 223 via lines 533, 535 and 517 through a connection made by solenoid valve 515.

Pressure transducer 537 monitors the fluid pressure in hydraulic accumulator 531. When the pressure falls below a predetermined point, pressure transducer 537 signals hydraulic pump 525 and electric motor 529 to enable hydraulic pump 525 to restore fluid pressure and volume to accumulator 531 from hydraulic fluid tank 511.

Figure 6:
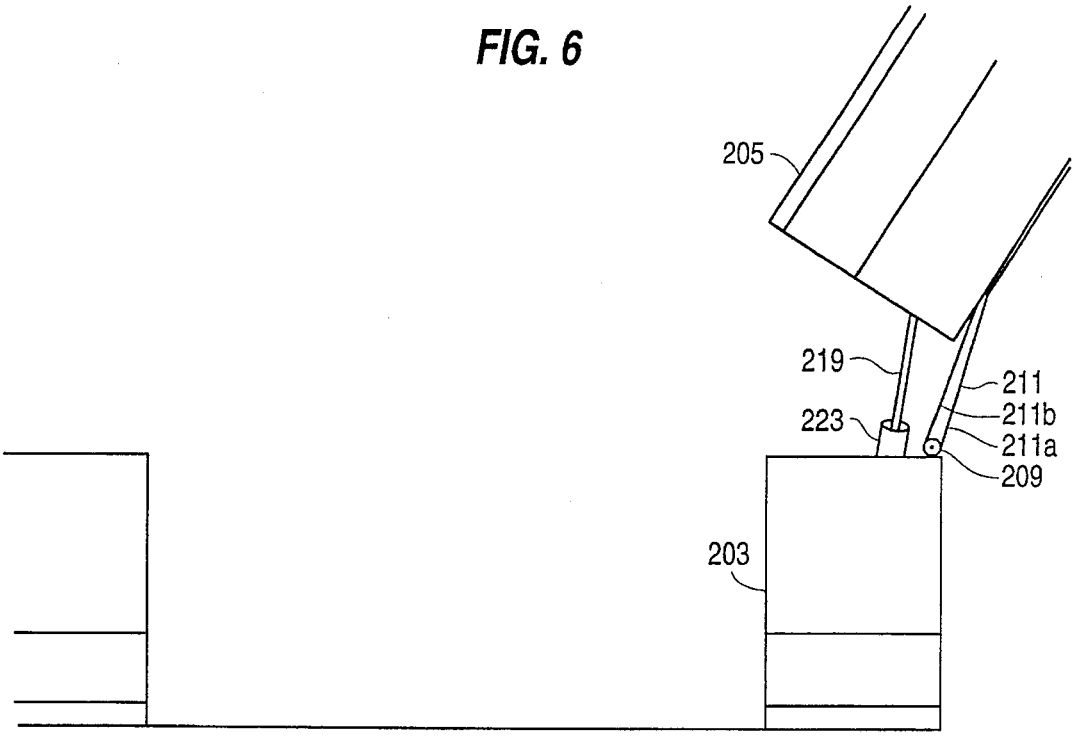
FIG. 6 shows the first embodiment of the present invention with the hinged shell in the upright open position.

FIG. 6 shows a partial view in profile of hinged shell 205 in an upright open position. In the configuration shown in FIG. 6, hinged shell 205 is moved into a position which is fully clear of the space which it formerly occupied. Thus, a vehicle of any height could fit within this space. Alternatively, a moveable highway barrier according to the present invention could be configured such that the upright open position does not fully clear, in a lateral dimension, the space formerly occupied by hinged shell 205.

However, it is believed to be preferable to configure the system as shown in FIG. 6 such that any height vehicle can traverse the open space that hinged shell 205 formerly occupied. To accomplish this, i.e., to fully clear the opening, a specific orientation of the system components is necessary.

Returning to FIG. 2B, hinge 209 is positioned above stationary barrier section 203 near the end of stationary barrier section 203 opposite hinged shell 205. Using typical road barrier dimensions currently is use, the center of hinge 209 will be approximately 34 inches from the road surface, although this distance would be different for differently dimensioned barriers. The hinged shell 205 must rotate through a certain minimum angle in order to fully clear the opening. For a hinged shell 205 of 12 feet in length, and the hinge height of 34 inches, a rotational angle of 103.285 degrees is required. It will be known to those of ordinary skill, that the dimensions provided herein are based on barriers currently in use and are by way of illustration and not limitation.

While hinged shell 205 rotates around hinge 209, the distance A between clevis point 215 and hinge 209 will remain constant. Also, the distance B between clevis point 217 and hinge 209 will remain constant. However, the distance C between clevis points 215 and 217 will obviously change as piston rod 219 extends from piston cylinder 223. As shown, a slight lateral offset D is preferred between hinge 209 and clevis point 217, such that clevis point 217 is not directly below hinge 209, but is offset in the direction of the hinged shell 205 (to the left in the orientation of FIG. 2B). This offset is to insure that piston 221 does not contact hinge 209 while positioning hinged shell 205 in the open position. An offset of approximately 8 inches has been found to be sufficient. Also, a vertical center to center distance between hinge 209 and clevis point 217 of 31 inches is preferred.

Next, a hydraulic cylinder must be selected to serve as piston 221. The hydraulic cylinder must have closed and extended lengths which enable the hinged shell to move between the standard (or closed) and open positions. A hydraulic cylinder with a 44 inch closed length and an 80 inch extended length has been selected as a preferred example.

Given the above dimensions, clevis point 215 can be placed anywhere along an arc with a radius of 44 inches centered around clevis point 217. However, only one point along this arc will result in the required rotation around hinge 209 of 103.285 degrees and maintain distance A as a constant. This point is 11.146 inches below the center of hinge 209, and 47.266 inches forward of the center of hinge 209, as shown.

Preferably, in a 12 foot embodiment, hydraulic accumulator 531 is fully charged for three complete cycles of movement of hinged shell 205. To accomplish this, a 15-gallon accumulator containing 7.5 gallons of oil and 7.5 gallons of nitrogen at 1,500 lbs. per square inch provides sufficient stored energy. Pressure transducer 537 should be set such that pump 525 is energized whenever the pressure falls below a predetermined level. In the case of the 1,500 lbs. per square inch hydraulic accumulator described above, a good predetermined threshold level might be 1,300 lbs. per square inch representing a loss in pressure of 200 lbs. per square inch. Thus, whenever the pressure drops below 1,300 lbs. per square inch, pressure transducer 537 will cause hydraulic pump 525, under the power of electric motor 529, to pump a sufficient quantity of hydraulic fluid from hydraulic fluid tank 511 into hydraulic accumulator 531 to raise the pressure therein back to the original 1,500 lbs. per square inch.

Figure 7:
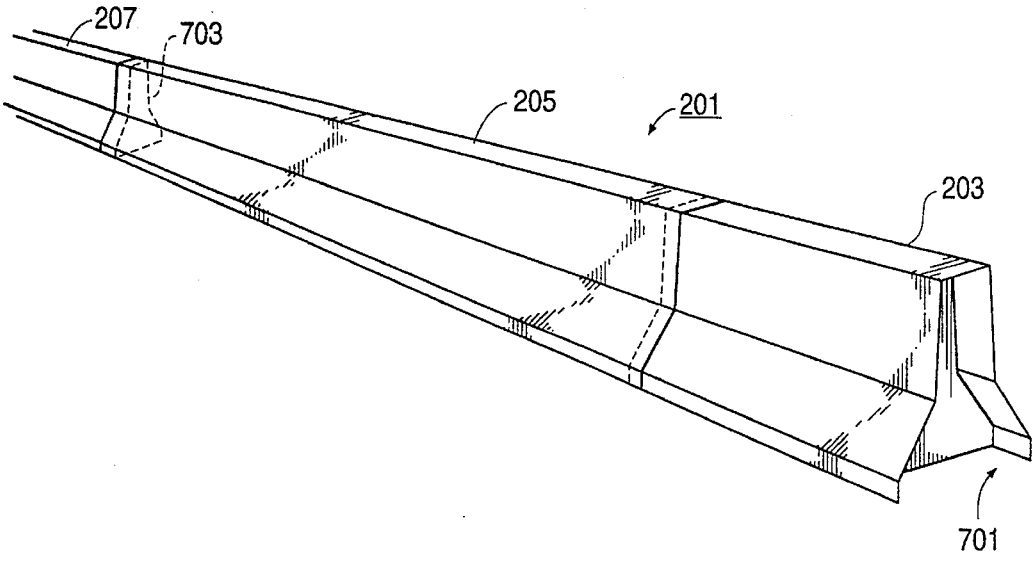
FIG. 7 shows an alternative of the first embodiment of the invention wherein the moveable highway barrier overlaps adjacent barriers.

FIG. 7 shows a preferred embodiment of the above described moveable highway barrier wherein stationary barrier 203 and hinged shell 205 are configured to overlap adjoining substantially fixed barriers. To this end, recessed area 701 is provided in stationary barrier section 203 to be fit over an adjacent substantially fixed barrier. In addition, stationary barrier section 203 can be connected to the neighboring substantially fixed barrier with bolts or any other appropriate means of connection. Similarly, when in the lowered closed position, hinged shell 205 overlaps substantially fixed barrier 207 such that the end face 703 of substantially fixed barrier 207 is at a point inside hinged shell 205. This configuration allows additional lateral strength by interconnecting a moveable highway barrier with its neighboring substantially fixed barrier sections. Further, hinged shell 205 can be configured such that a portion of hinged shell 205 overlaps stationary barrier section 203 when in the lowered closed position, thus providing even greater lateral strength and integrity.

In addition, the above described system can be configured with visible warning signals, such as strobe lights, which are energized while the hinged shell is away from the lowered closed position. These lights would thus provide a warning to oncoming traffic that a vehicle is about to make a U-turn. Safety concerns may also dictate an audible alarm which is engaged while hinged shell 205 is moving. The lights and alarms can be made to turn on slightly in advance of the onset of motion.

The system according to the invention can also be equipped with an object detector which operates when the moveable highway barrier is open to prevent it from closing on a person, car or other object. Any suitable object detector of conventional design can be used to perform this safety function.

Figure 8:
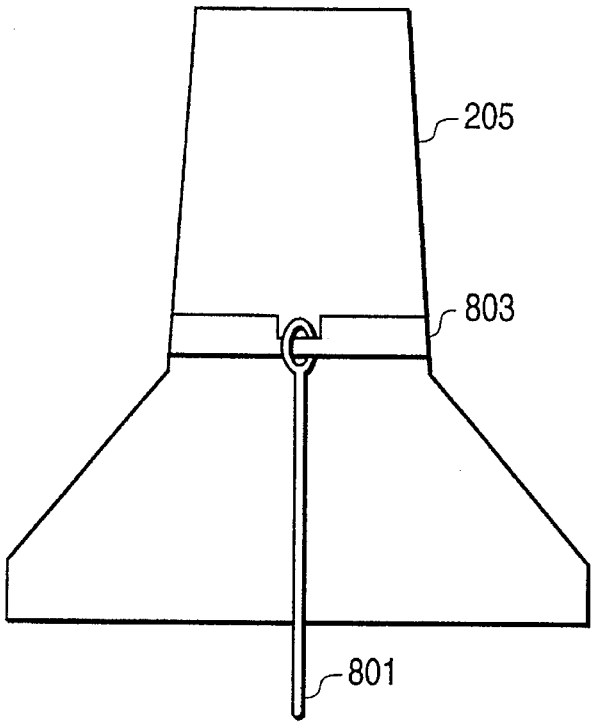
FIG. 8 shows another alternative of the first embodiment incorporating a gravity pin for additional lateral support.

To further enhance the lateral strength of hinged shell 205, a gravity pin, such as gravity pin 801 mounted to support member 803 in FIG. 8, can be provided. As shown, when hinged shell 205 is moved into the upright open position, pin 801 will swing into a position substantially parallel to the longitudinal axis of hinged shell 205 such that it is out of the way. When hinged shell 205 is moved towards the lowered closed position, on the other hand, gravity pin 801 will move toward a position substantially perpendicular to the longitudinal axis of hinged shell 205, into the orientation shown in FIG. 8. A hole in the roadbed can be positioned such that it is in alignment with gravity pin 801 when hinged shell 205 is in the lowered closed position. Thus, when hinged shell 205 is in the lowered closed position, gravity pin 801, while in engagement with the aligned hole, will provide additional lateral support.

As an alternative to the gravity pin shown in FIG. 8, a spring loaded pin can be provided to similarly engage with a hole in the roadbed. Since hinged shell 205 rotates further than 90 degrees, such a spring loaded pin could be positioned such that it does not interfere with the desired 12 foot opening. Thus, the further towards the free end such a pin is located, the greater the acceptable pin length. A pin length of about 4 to 6 inches should provide additional lateral support and not interfere if placed near the free end of hinged shell 205.

Figure 9:
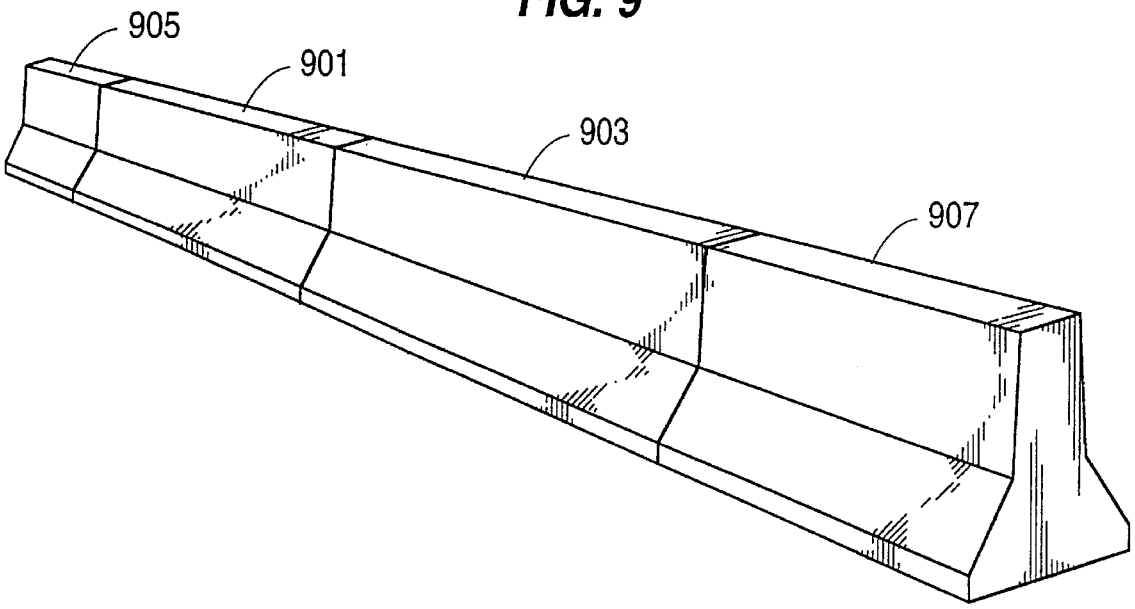
FIG. 9 shows a second embodiment of the invention containing two hinged shells and two stationary barrier sections.

FIG. 9 shows an alternative embodiment wherein two hinged shells 901 and 903 are connected respectively to stationary barrier sections 905 and 907. Here, hinged shells 901 and 903 are raised in opposite directions. Each of hinged shells 901 and 903 is raised substantially as previously described herein in order to open the space they previously occupied for vehicle traversal. Preferably, hinged shells 901 and 903 are configured such that one of them overlaps the other when they are both in the lowered closed position. Hinged shells 901 and 903 can therefore be closed in a predetermined sequence to insure that the one which is supposed to overlap the other either closes at a slower rate or waits until the other is closed before beginning its descent. A simple method of providing this level of control is by incorporating a limit switch to inform the overlapping hinged shell when the other hinged shell has reached a predetermined position. The overlapping hinged shell can then begin its descent upon receipt of the signal from this limit switch.

Figure 10:
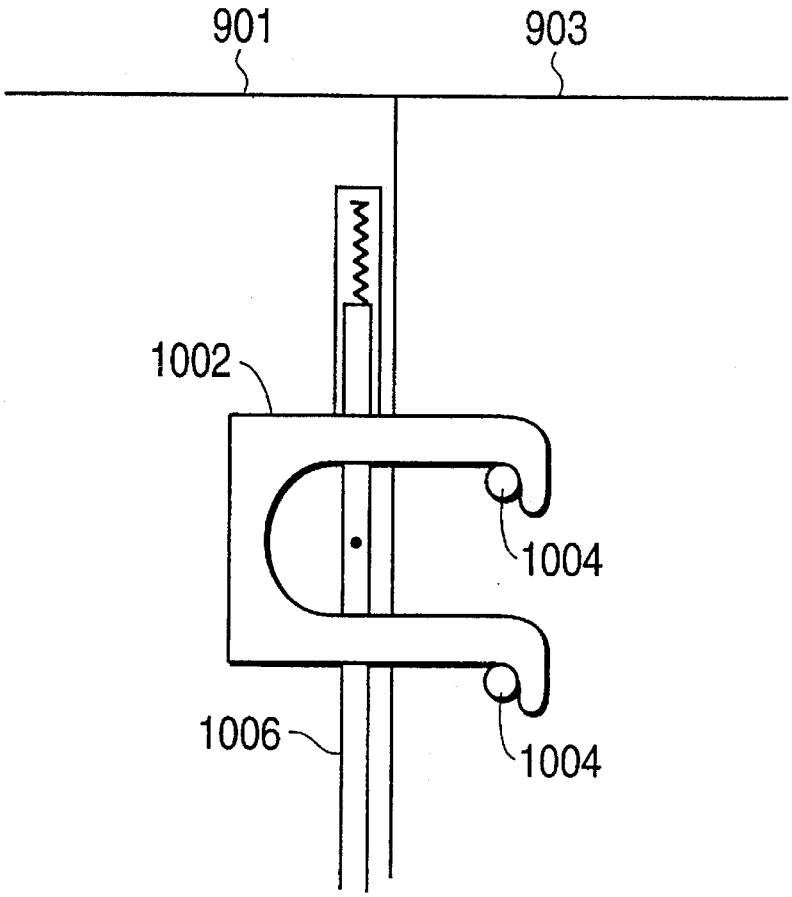
FIG. 10 incorporates optional gravity or spring loaded pins and cam-lock plates into the embodiment of FIG. 9 to provide additional lateral support and impart a slight tension between the two hinged shells.
Figure 11:
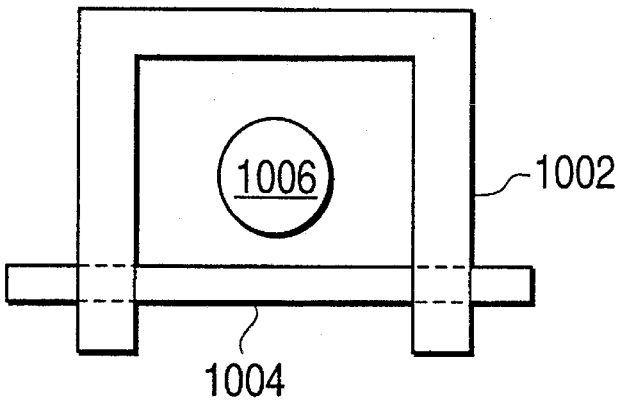
FIG. 11 shows a top view of the embodiment of FIG. 10.

In addition, as shown in FIG. 10, the overlapping hinged shell can be configured with a set of cam plates 1002 to grasp mating locking pins 1004 positioned on the other hinged shell. This will produce a slight tension and lateral stability resistance in the hinged shells. Also, a spring loaded or gravity pin 1006 such as that discussed above can be situated between the cam plates, as shown in FIG. 10. FIG. 11 shows a top view of cam plates 1002, locking pins 1004 and gravity pin 1006 of the embodiment shown in FIG. 10.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A moveable highway barrier, comprising:

a hinged shell pivotally linked to a stationary barrier section and having a profile matching a profile of the stationary barrier section; and means, connected to the hinged shell, for moving the hinged shell between an upright open position and a lowered closed position.

2. A moveable highway barrier as recited in claim 1, wherein the means for moving the hinged shell comprises an electrohydraulic system including a hydraulic cylinder having a piston rod, the piston rod being connected to the hinged shell via a clevis pin.

3. A moveable highway barrier as recited in claim 2, wherein the means for moving the hinged shell is substantially contained within the stationary barrier section.

4. A moveable highway barrier as recited in claim 2, wherein the hydraulic cylinder has a piston side and a rod side, the hydraulic cylinder further having an open end at the rod side, and wherein the electrohydraulic system further comprises:

a solenoid valve connecting the hydraulic cylinder to a hydraulic accumulator and a hydraulic fluid tank, and a hydraulic pump connected between the hydraulic accumulator and the hydraulic fluid tank, the solenoid valve linking the accumulator to the piston side of the hydraulic cylinder, causing hydraulic fluid to displace the piston rod in an axial direction out of the open end of the hydraulic cylinder, when the hinged shell is moved to the upright open position, and the solenoid valve linking the accumulator to the rod side of the hydraulic cylinder, pressuring the piston rod to cause it to move in an axial direction into the open end of the hydraulic cylinder, when the hinged shell is moved to the lowered closed position.

5. A moveable highway barrier as recited in claim 4 wherein, when the hinged shell is placed in the upright open position, the solenoid valve further connects the rod side of the hydraulic cylinder to the hydraulic fluid tank to drain hydraulic fluid from the rod side, and when the hinged shell is placed in the lowered closed position, the solenoid valve further connects the piston side of the hydraulic cylinder to the hydraulic fluid tank to drain hydraulic fluid from the piston side.

6. A moveable highway barrier as recited in claim 5, further comprising a limit switch connected to the solenoid, the limit switch sensing the position of the hinged shell as the hinged shell transitions from the lowered closed position to the upright open position, the limit switch de-energizing the solenoid valve when the hinged shell reaches a predetermined arcuate position relative to the stationary barrier section.

7. A moveable highway barrier as recited in claim 4, further comprising a sensor connected to the hydraulic accumulator and the hydraulic pump, the sensor causing the hydraulic pump to pump hydraulic fluid from the hydraulic fluid tank into the hydraulic accumulator when a pressure level in the hydraulic accumulator is below a predetermined minimum level.

8. A moveable highway barrier as recited in claim 7, further comprising an electric motor connected to the hydraulic pump, the electric motor driving the hydraulic pump, and a battery connected to the electric motor, the battery providing operating power to the electric motor.

9. A moveable highway barrier as recited in claim 8, further comprising a solar energy collector connected to the battery, the solar energy collector recharging the battery.

10. A moveable highway barrier as recited in claim 9, wherein the solar energy collector is positioned along a top surface of the hinged shell.

11. A moveable highway barrier as recited in claim 1, wherein the stationary barrier section is connected to a substantially fixed barrier.

12. A moveable highway barrier as recited in claim 11, further comprising another substantially fixed barrier positioned in line with the hinged shell at a side of the hinged shell opposite the stationary barrier section, wherein the hinged shell contains a first flange portion which overlaps part of the another substantially fixed barrier when the hinged shell is in the lowered closed position, and the stationary barrier section contains a second flange portion which overlaps part of the substantially fixed barrier.

13. A moveable highway barrier as recited in claim 1, further comprising a receiver coupled to the means for moving the hinged shell, the receiver being configured to receive singals and convert the signals into drive signals to cause the means for moving the hinged shell to open and closed the hinged shell in compliance with the signals received.

14. A moveable highway barrier as recited in claim 1, further comprising a visible warning indicator activated when the hinged shell moves away from the lowered closed position.

15. A moveable highway barrier as recited in claim 1, further comprising an audible alarm which transmits when the hinged shell moves.

16. A moveable highway barrier as recited in claim 1, further comprising a pin connected to the hinged shell, the pin being positioned on the shell to engage a hole in a roadway when the hinged shell is in the lowered closed position.

17. A moveable highway barrier as recited in claim 16, wherein the pin is a gravity pin.

18. A moveable highway barrier as recited in claim 16, wherein the pin is a spring loaded pin.

19. A moveable highway barrier, comprising a first hinged shell pivotally linked to a first stationary barrier section, the first hinged shell having a flange portion;

a second hinged shell pivotally linked to a second stationary barrier section and having a mating portion for engaging the flange portion;

means, connected to the first and second hinged shells, for moving the first and second hinged shells between upright open positions and lowered closed positions;

wherein the flange portion of the first hinged shell overlaps the mating portion of the second hinged shell when both the first and second hinged shells are in the lowered closed position.

20. A moveable highway barrier as recited in claim 19, wherein the means for moving the first and second hinged shells comprises a first electrohydraulic unit connected to the first hinged shell and a second electrohydraulic unit connected to the second hinged shell.

21. A method of configuring a moveable highway barrier, the method comprising the steps of:

connecting a stationary barrier section to a substantially fixed barrier;

connecting a moveable shell having a profile matching a profile of the stationary barrier section and the substantially fixed barrier to the stationary barrier section; and connecting a drive means to the moveable shell such that the drive means moves the moveable shell between an upright open position and a lowered closed position.

22. A method as recited in claim 21, further comprising the step of positioning another substantially fixed barrier in line with the moveable shell at a side of the moveable shell opposite the stationary barrier section such that a flange portion of the moveable shell overlaps the another substantially fixed barrier when the moveable shell is in the lowered closed position.

23. A moveable highway barrier, comprising:

a hinged shell pivotally linked to a stationary barrier section; and means, connected to the hinged shell, for moving the hinged shell between an upright open position and a lowered closed position, wherein, when the hinged shell is in the lowered closed position, a profile of a combination of the hinged shell and the stationary barrier section matches a profile of the stationary barrier section.

24. A moveable highway barrier, comprising:

a hinged shell pivotally linked to a stationary barrier section; and means, connected to the hinged shell, for moving the hinged shell between an upright open position and a lowered closed position, wherein the means for moving the hinged shell comprises an electrohydraulic system including:

a hydraulic cylinder having a piston side and a rod side, the hydraulic cylinder further having an open end at the rod side and a piston rod connected to the hinged shell via a clevis pin, a solenoid valve connecting the hydraulic cylinder to a hydraulic accumulator and a hydraulic fluid tank, and a hydraulic pump connected between the hydraulic accumulator and the hydraulic fluid tank, the solenoid valve linking the accumulator to the piston side of the hydraulic cylinder, causing hydraulic fluid to displace the piston rod in an axial direction out of the open end of the hydraulic cylinder, when the hinged shell is moved to the upright open position, and the solenoid valve linking the accumulator to the rod side of the hydraulic cylinder, pressuring the piston rod to cause it to move in an axial direction into the open end of the hydraulic cylinder, when the hinged shell is moved to the lowered closed position.

25. A moveable highway barrier, comprising:

a hinged shell pivotally linked to a stationary barrier section; and means, connected to the hinged shell, for moving the hinged shell between an upright open position and a lowered closed position, wherein the means for moving the hinged shell comprises an electrohydraulic system including:

a hydraulic cylinder having a piston side and a rod side, the hydraulic cylinder further having an open end at the rod side and a piston rod connected to the hinged shell via a clevis pin, and a solenoid valve connecting the hydraulic cylinder to a source of hydraulic power, wherein the solenoid valve links the source of hydraulic power to the piston side of the hydraulic cylinder, causing hydraulic fluid to displace the piston rod in an axial direction out of the open end of the hydraulic cylinder, when the hinged shell is moved to the upright open position, and wherein the solenoid valve links the source of hydraulic power to the rod side of the hydraulic cylinder, pressuring the piston rod to cause it to move in an axial direction into the open end of the hydraulic cylinder, when the hinged shell is moved to the lowered closed position.

* * * * *